US006527110B2

(12) United States Patent
Moscovitz

(10) Patent No.: US 6,527,110 B2
(45) Date of Patent: Mar. 4, 2003

(54) DEVICE FOR STORING AND DISPENSING A SUBSTANCE BY MATING WITH A CONTAINER AND ASSOCIATED METHODS

(76) Inventor: Brett Moscovitz, 320 E. South St., Suite 180, Orlando, FL (US) 32801

( * ) Notice: Subject to any disclaimer, the term of this patent is extended or adjusted under 35 U.S.C. 154(b) by 0 days.

(21) Appl. No.: 09/870,847

(22) Filed: May 31, 2001

(65) Prior Publication Data

US 2002/0066677 A1 Jun. 6, 2002

Related U.S. Application Data

(60) Provisional application No. 60/250,719, filed on Dec. 1, 2000, and provisional application No. 60/275,777, filed on Mar. 14, 2001.

(51) Int. Cl.[7] ..... B65D 25/08; B67D 5/00

(52) U.S. Cl. ..... 206/222; 215/DIG. 8; 222/83

(58) Field of Search ..... 206/219, 221, 206/222; 222/83, 129; 215/DIG. 8, 250, 253, 257

(56) References Cited

U.S. PATENT DOCUMENTS

| | | | | |
|---|---|---|---|---|
| 2,487,236 A | | 11/1949 | Greenberg | |
| 2,885,104 A | | 5/1959 | Greenspan | |
| 3,404,811 A | | 10/1968 | Cernei | |
| 4,307,821 A | * | 12/1981 | McIntosh | 222/83 |
| 4,634,003 A | | 1/1987 | Ueda et al. | 206/221 |
| 4,747,501 A | * | 5/1988 | Greaves | 215/253 |
| 4,779,722 A | | 10/1988 | Hall | 206/221 |
| 4,898,293 A | | 2/1990 | Morel | 215/250 |
| 5,000,314 A | | 3/1991 | Fuller et al. | 206/221 |
| 5,209,565 A | | 5/1993 | Goncalves | 366/130 |
| 5,275,298 A | | 1/1994 | Holley, Jr. et al. | 215/11.4 |
| 5,277,303 A | | 1/1994 | Goyet et al. | 206/221 |
| 5,474,209 A | | 12/1995 | Vallet Mas et al. | 222/83 |
| 5,678,709 A | | 10/1997 | Holley et al. | 215/11.4 |
| 5,685,422 A | | 11/1997 | Kim | 206/222 |
| 5,769,215 A | | 6/1998 | Kim | 206/222 |
| 5,772,017 A | | 6/1998 | Kang | 206/222 |
| 5,782,345 A | | 7/1998 | Gausch et al. | 206/222 |
| 5,863,126 A | | 1/1999 | Guild | 366/130 |
| 5,927,549 A | | 7/1999 | Wood | 222/83 |
| 5,941,380 A | | 8/1999 | Rothman | 206/222 |
| 6,021,892 A | | 2/2000 | Baudin | 206/221 |
| 6,113,257 A | | 9/2000 | Sharon et al. | 366/130 |
| 6,138,821 A | * | 10/2000 | Hsu | 206/222 |
| 6,152,296 A | * | 11/2000 | Shih | 206/222 |

FOREIGN PATENT DOCUMENTS

| | | | | |
|---|---|---|---|---|
| JP | 6-80166 | * | 3/1994 | 206/222 |

* cited by examiner

*Primary Examiner*—Bryon P. Gehman
(74) *Attorney, Agent, or Firm*—Allen, Dyer, Doppelt, Milbrath & Gilchrist, P.A.

(57) ABSTRACT

The storage device engages a container, such as a bottle, to dispense a stored substance into the bottle. The device includes a housing for storing the substance, and a breakable seal disposed in the housing adjacent an opening for sealing the substance in the housing. Furthermore, the device includes a breaking member carried by the housing between the opening and the breakable seal for being driven by the bottle when engaged with the device to break the seal and allow dispensing of the substance into the bottle.

18 Claims, 9 Drawing Sheets

DEVICE FOR STORING AND DISPENSING A SUBSTANCE BY MATING WITH A CONTAINER AND ASSOCIATED METHODS

RELATED APPLICATIONS

This patent application is based upon and claims priority to provisional application Nos. 60/250,719 filed Dec. 1, 2000 and 60/275,777 filed Mar. 14, 2001.

FIELD OF THE INVENTION

The present invention relates to containers, and, more particularly, to devices for storing and dispensing premeasured quantities of a substance.

BACKGROUND OF THE INVENTION

Beverage, food and drug manufacturers produce many different products which need to be or can be mixed with another substance, such as water, before consumption. Such products may include, for example, flavor syrups, powdered baby formula, powdered nutritional drink mix, liquor, suspension antibiotics or any other substance that could be mixed with another substance or liquid such as water, milk, juice or carbonated beverages, for example.

These products may be sold in bulk or as single servings packaged in cans, bottles, packets or other containers. Also, various containers have been designed for storing one or more of these products to be dispensed into another container such as a water bottle, baby bottle or cup. For example, U.S. Pat. No. 5,941,380 to Rothman, entitled "Device for Dispensing Flowable Material," discloses a storage cap having a receiving groove with a large diameter for mating with a number of different size bottle openings. Furthermore, the storage cap has a rupturable membrane which can be ruptured as a bottle neck is urged into the receiving groove.

U.S. Pat. No. 5,529,179 to Hanson, entitled "Dispensing lid for beverage container," discloses a dispensing lid for the circular upper rim of a drinking cup. Frangible vessels contain condiments and are disposed within the lid. Condiments are released form the vessels when finger pressure is applied thereto the vessels.

U.S. Pat. No. 5,500,314 to Fuller et al., entitled "Unit Dose Package," discloses a unit dose storage cap for storing and dispensing a dose of infant and adult nutritional formulas. The cap has a threaded mouth designed to be fitted onto the wide neck of a infant formula bottle. A foil seal is removed before the storage cap is secured to the bottle. In another embodiment of the invention, the dose cap has a water soluble seal which dissolves into the formula bottle.

One problem with some of the conventional devices is that none provide a reliable seal that can be broken after the device is securely connected to a bottle. Without a reliable seal and a secure connection between the device and the bottle, the contents stored in the device may spill and/or be contaminated.

SUMMARY OF THE INVENTION

In view of the foregoing background, it is therefore an object of the invention to provide a storage and dispensing device with a reliable seal that can be broken after the device is securely connected to a bottle.

It is also an object of the invention to provide a method of storing a substance in a sealed device and then reliably dispensing the substance into a bottle securely connected to the device.

This and other objects, features and advantages in accordance with the present invention are provided by a storage and dispensing device for engaging a container and dispensing a stored substance therein. The device includes a housing defining a chamber for storing the substance, and having an end and an opening adjacent thereto. The device also includes a breakable seal adjacent the opening of the housing for sealing the substance in the chamber, and a breaking member carried by the housing outside the chamber and adjacent the opening and the breakable seal for being driven by the container when engaged with the device to break the seal and allow dispensing of the substance into the container.

The breaking member may include a protruding portion and at least one opening therein. In one embodiment, the end of the housing may include internal threads, between the opening and the breakable seal, for mating with the container. In another embodiment, the breaking member may comprise a piston slidably disposed in the end of the housing. Furthermore, the breaking member may comprise a container mating portion for mating with the container, and a housing receiving portion for receiving the housing therein.

In another embodiment, the breaking member may have internal threads and external threads, the internal threads for mating with the container. Here, the end of the housing may include internal threads, between the opening and the breakable seal, for mating with the external threads of the breaking member. The breakable seal may be integrally formed with the housing as a monolithic unit, and may include lines of weakness to aid in the breaking of the seal by the breaking member. Also, the breakable seal may be a foil seal. Additionally, a cap may be provided for closing a second opening of the housing.

Objects, features and advantages in accordance with the present invention are also provided by a method of dispensing a first substance into a container for mixture with a second substance. The method includes storing the first substance in a chamber of a device having an end and an opening adjacent thereto, and sealing the first substance in the chamber with a breakable seal adjacent the opening. A breaking member is provided with the device outside the chamber and adjacent the opening and the breakable seal, and the device is engaged onto the container to drive the breaking member to break the seal and dispense the first substance into the container.

DETAILED DESCRIPTION OF THE PREFERRED EMBODIMENTS

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

Figure 1:
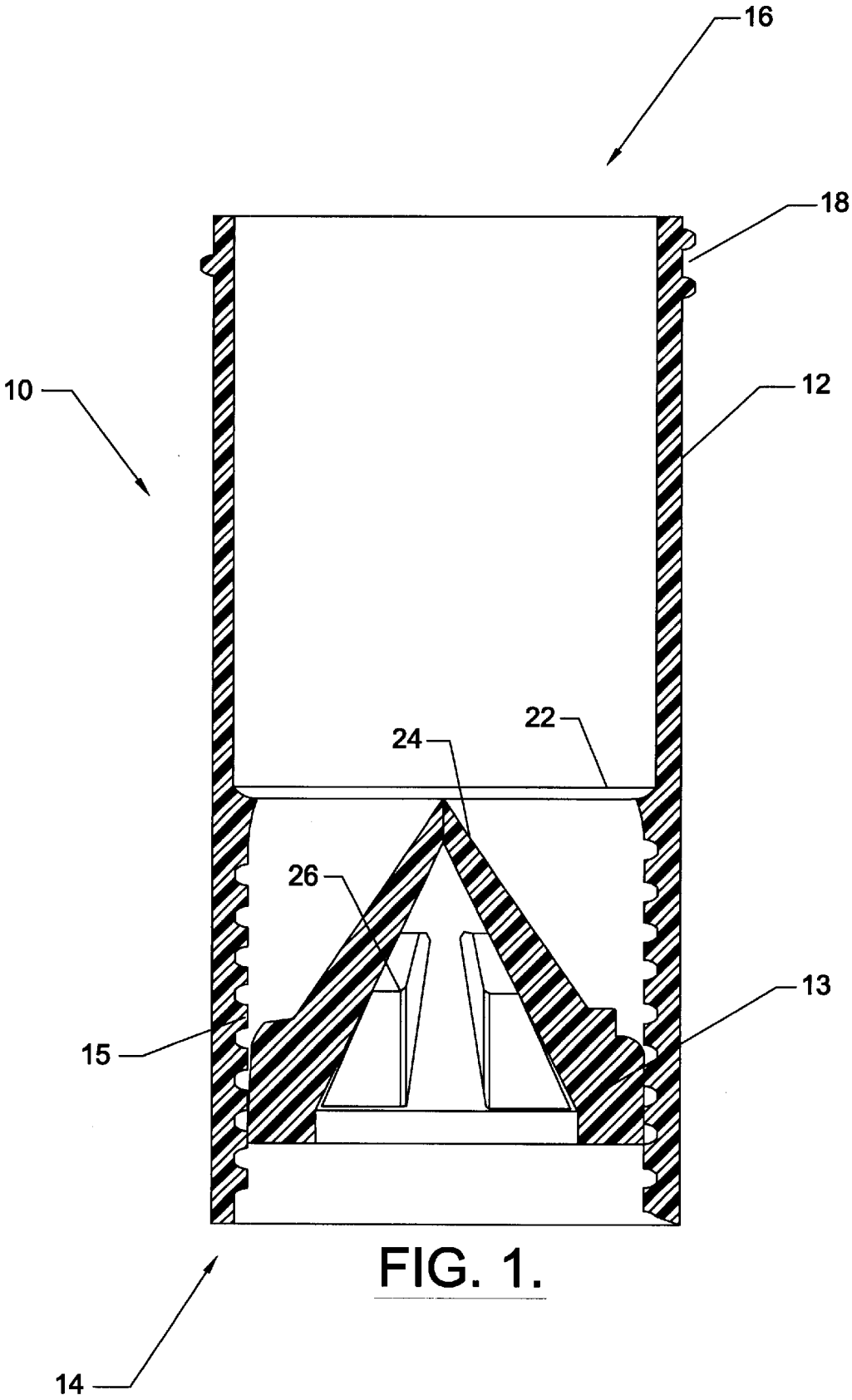
FIG. 1 is a cross-sectional view of an embodiment of the device of the present invention.
Figure 2:
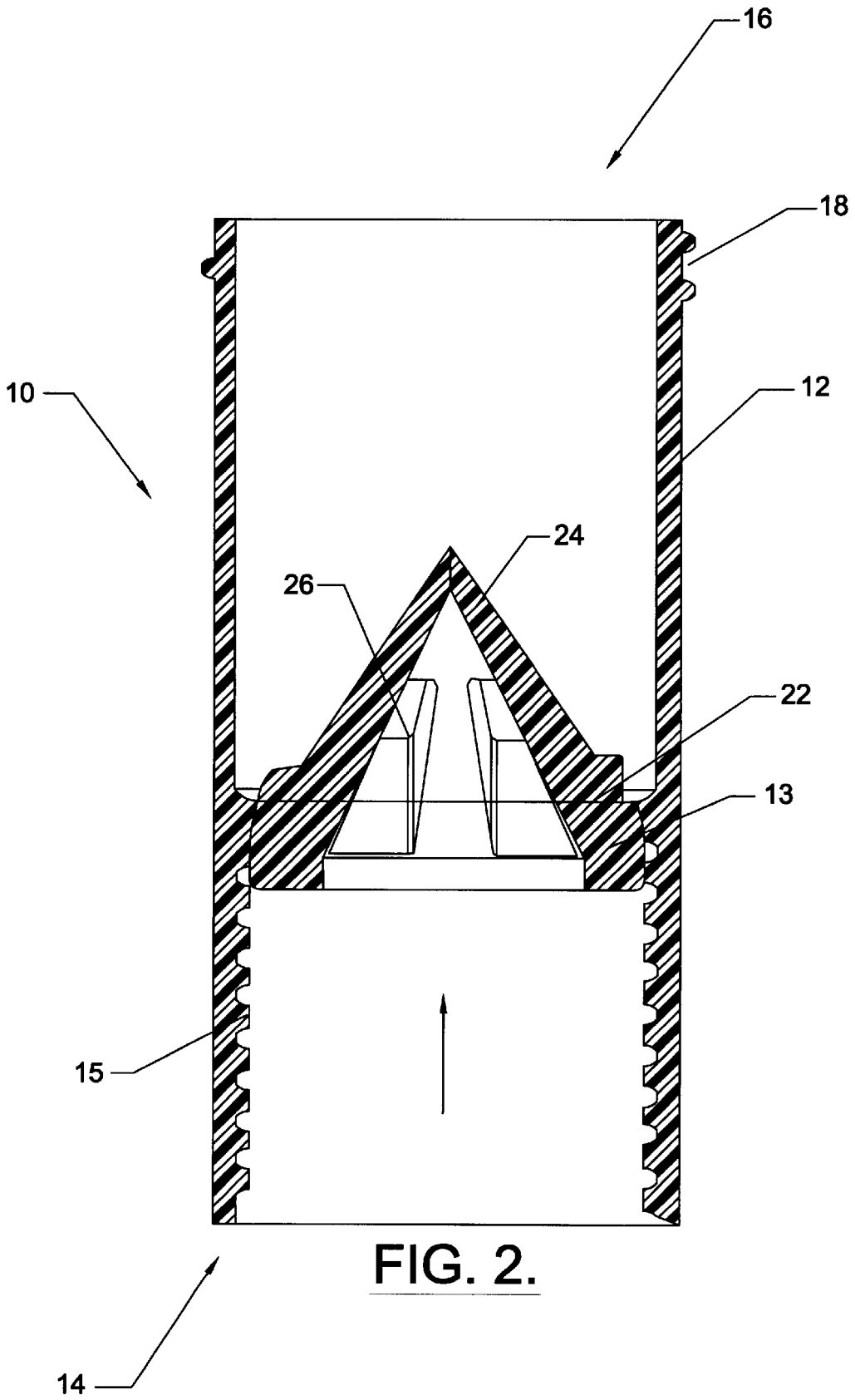
FIG. 2 is a cross-sectional view of the device of FIG. 1 illustrating an upward position of the piston.
Figure 3:
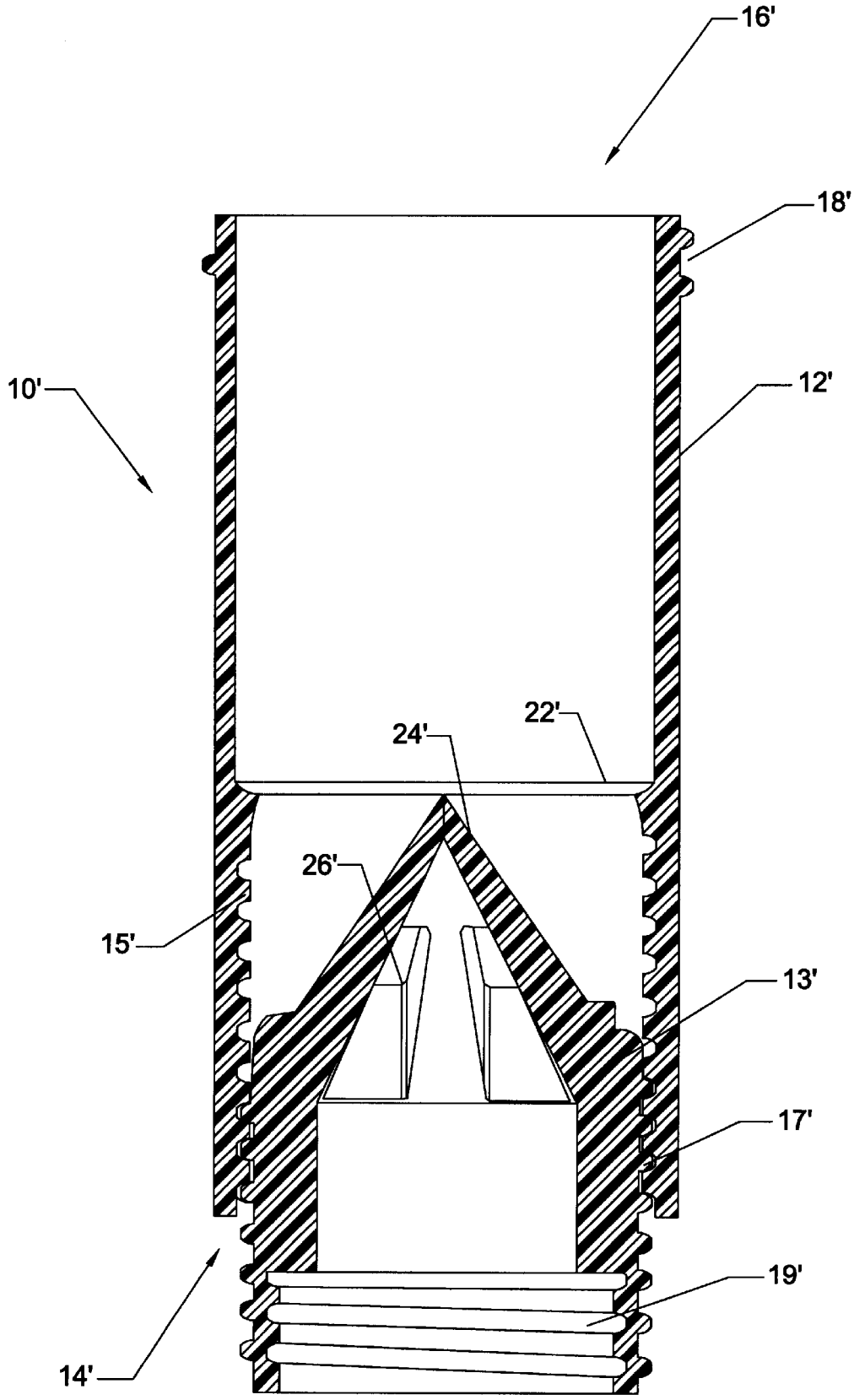
FIG. 3 is a cross-sectional view of another embodiment of the device of the present invention.

Referring to FIGS. 1 and 2, an example of an embodiment of the device 10 will now be described. The device 10 includes a housing 12 having a first opening 14 and second opening 16 at opposite ends of the housing and defining a chamber therein. The first opening may include internal threads 15 for mating with the external threads of a container such as a water bottle. The second opening 16 may include external threads 18 for mating with a bottle cap or other appropriate closure for sealing the device 10. The device 10 also includes a breakable or rupturable seal or inner wall member 22 disposed between the substance contained in the chamber of the housing 12 and the opening 14.

A breaking member or piston 13 having a protruding portion 24 and openings 26 is also provided between the seal 22 and the first opening 14. The piston 13 may be secured within the internally threaded portion 15 of the first opening 14 via one or more tabs or friction fit, for example. The piston 13 may also be secured within the first opening 14 via a snap fit, receiving grooves, protruding rings or any other fitting that would reliably secure the piston within the opening while allowing movement therein. At a desired time, the device 10 may be screwed on to a container via internally threaded portion 15. The piston is driven toward the seal 22 via the force of the container. As such, the protruding portion 24 of the piston 13 begins to press on the seal 22 until such seal 22 is broken, ruptured, pierced, split etc., to expose the substance in the housing 12 to the liquid in the other container to produce a mixture. Of course the connected device and container may be shaken or swirled to aid in the mixing of the substance and the liquid.

Figure 9:
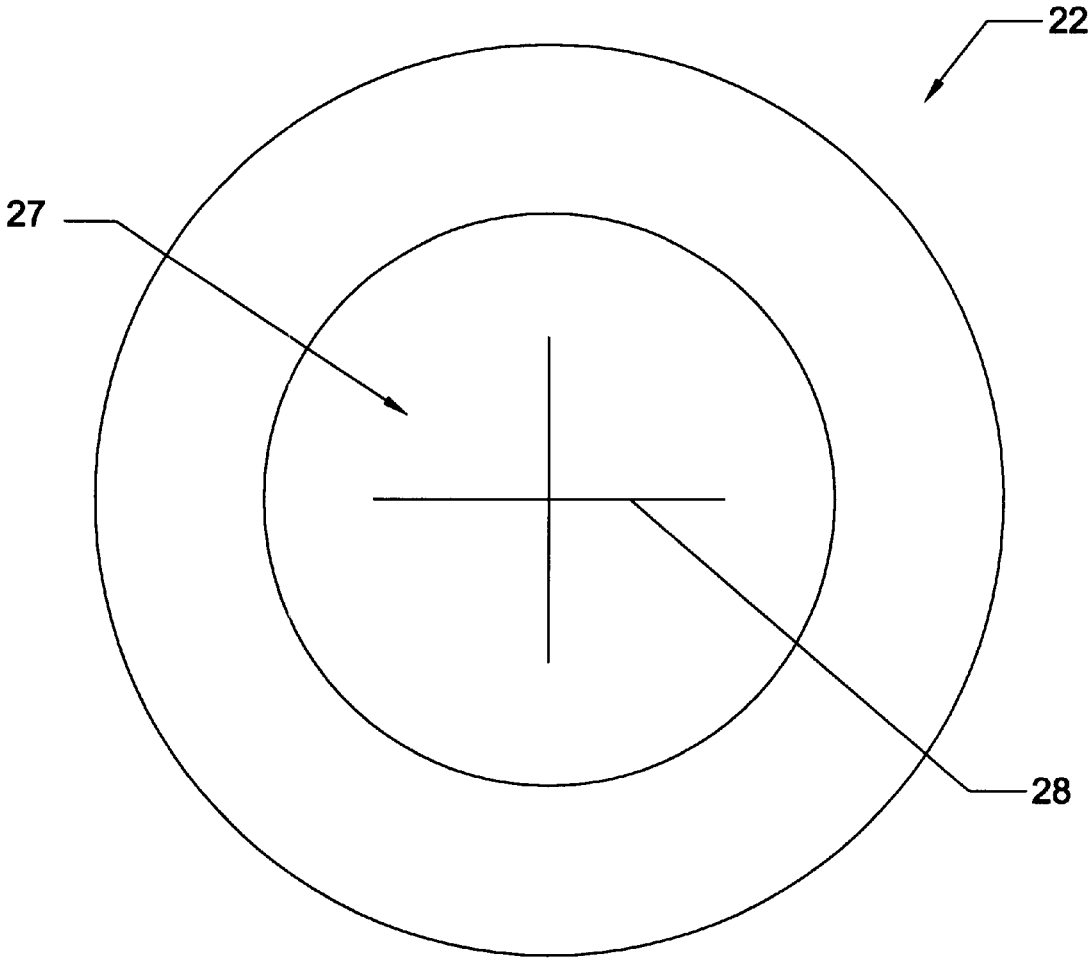
FIG. 9 is a schematic view of an embodiment of the seal of the device of the present invention.

The seal 22, as shown in FIG. 9, may be a thinned wall portion 27 and is preferably formed with lines of weakness 28 to aid in the breaking or rupturing of the seal. The seal 22 may also be a membrane made of plastic, foil or any other material which would provide a reliable seal and be capable of opening, breaking, tearing, rupturing, splitting or ripping, for example, in response to pressure exterted by the protruding portion 24. Such a membrane may also be formed with lines of weakness to aid in the breaking or rupturing of the seal 22.

Figure 4:
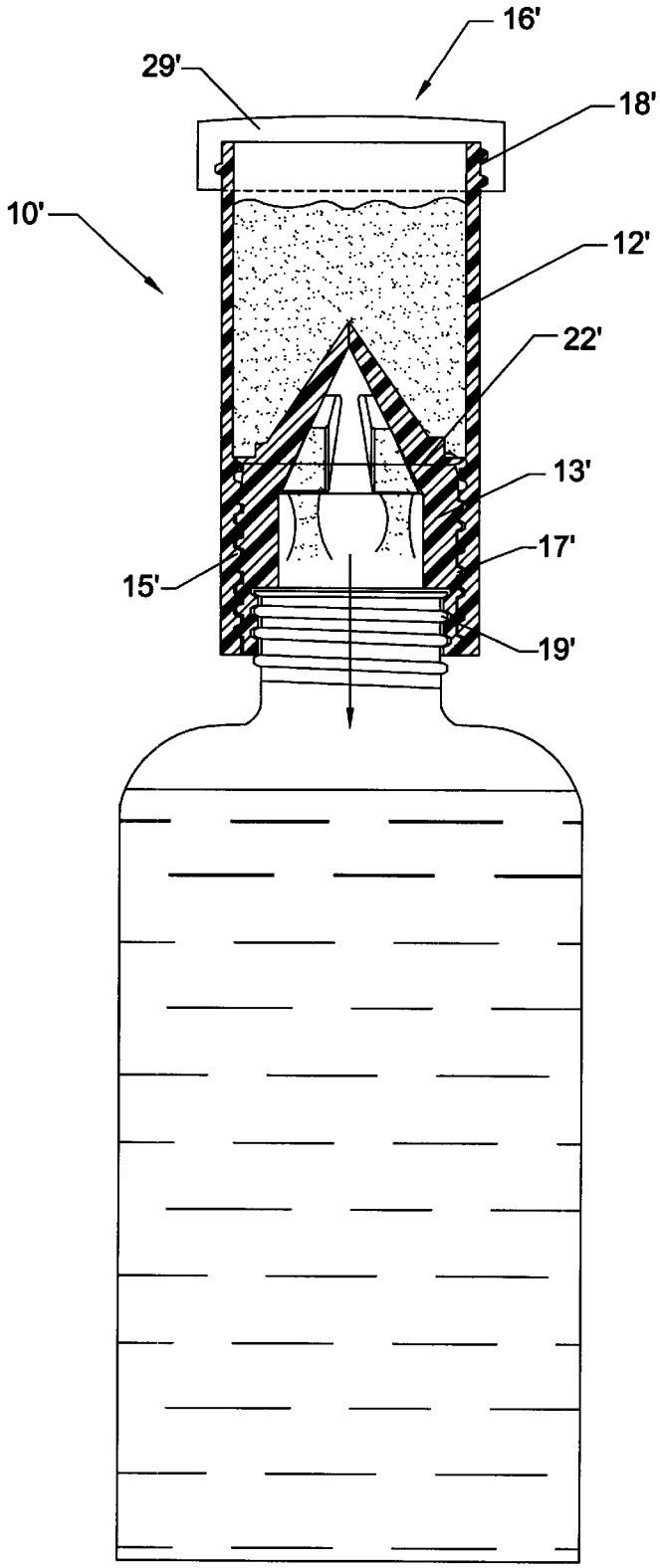
FIG. 4 is a cross-sectional view of the device of FIG. 3 mounted on a bottle.
Figure 5:
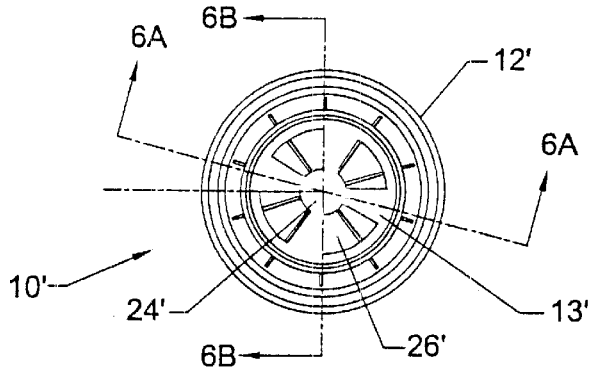
FIG. 5 is a top view of the device of FIG. 3.
Figure 6A:
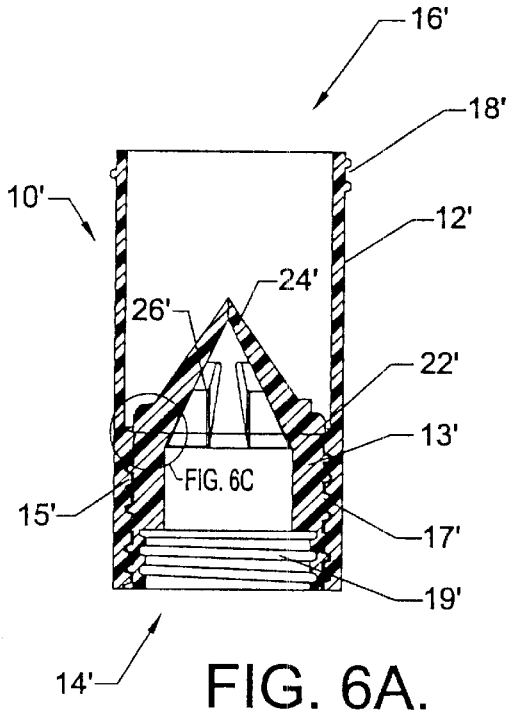
FIGS. 6A–6D are cross-sectional and enlarged views illustrating the details of the device of FIG. 3.
Figure 6B:
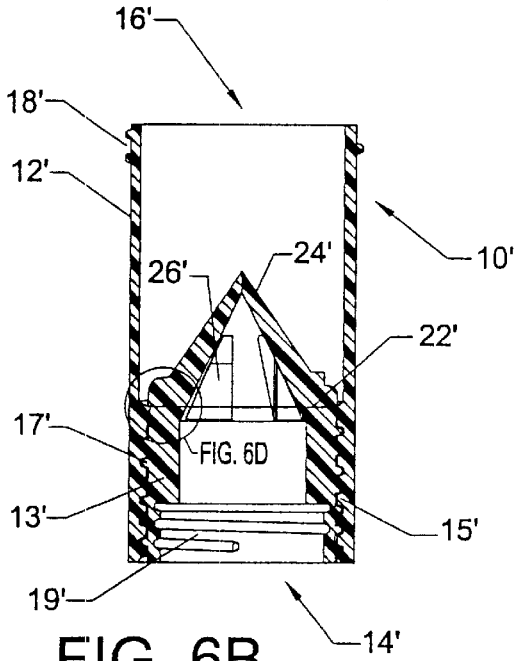
Figure 6D:
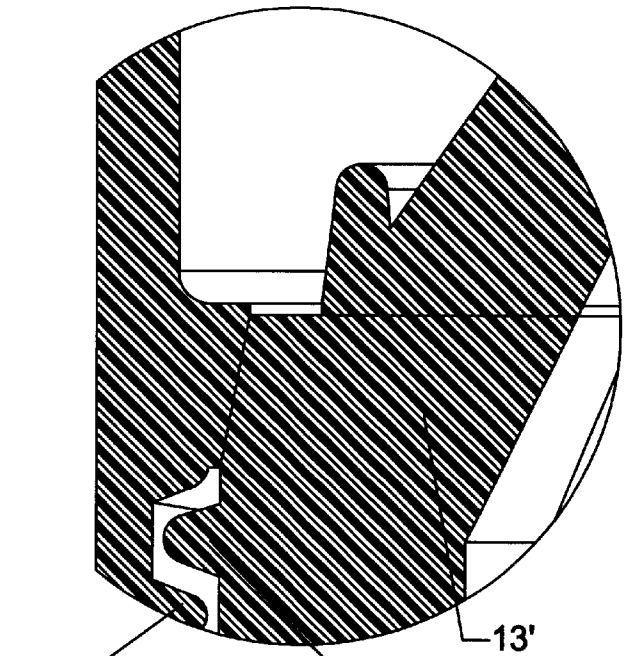
Figure 6C:
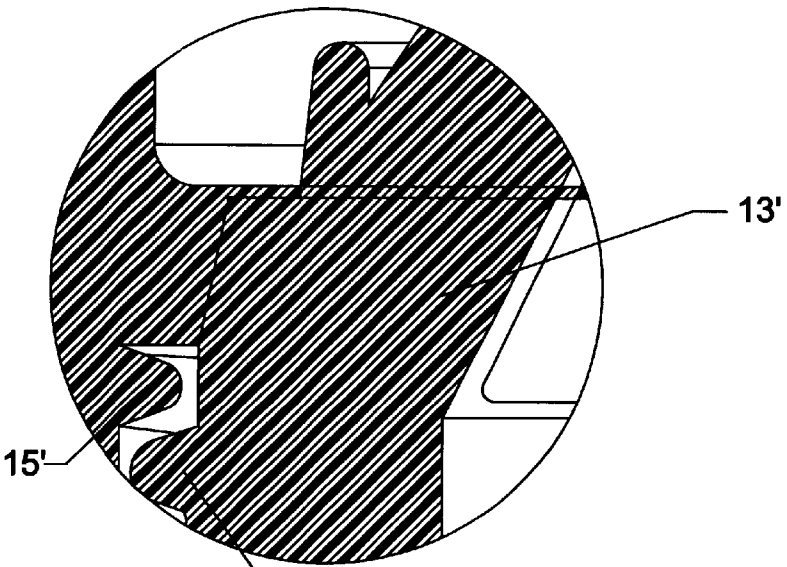

Referring to FIGS. 3–6, another embodiment of the device 10' will now be described. The device 10' includes a housing 12' having a first opening 14' and second opening 16' at opposite ends of the housing. The first opening 14' may include internal threads 15' for mating with the external threads 17' of a breaking cap 13'. The breaking cap 13' also includes internal threads 19' for mating with a bottle top, for example, as shown in FIG. 4. The second opening 16' may include external threads 18' for mating with a bottle cap 29' or other appropriate closure for sealing the device 10'. The device 10' also includes a breakable or rupturable seal or inner wall member 221 disposed between the substance contained in the housing 12' and the opening 14'. Again, the seal 22' may be a thinned wall portion and is preferably formed with lines of weakness to aid in the breaking or rupturing of the seal.

The breaking cap 13' may have a protruding portion 24' and openings 26', and is provided between the seal 22' and the first opening 14'. At a desired time, the device 10' may be screwed on to another container via internal threads 19' of the breaking cap 13'. The breaking cap 13' is driven toward the seal 22' after the bottle reaches the upper limit of the internal threads 19' of the breaking cap 13'. As such, the protruding portion 24' begins to press on the seal 22' until such seal 22' is opened, broken or ruptured to expose the substance in the housing 12' to the liquid in the container to produce a mixture. Of course the connected device and containers may be lightly shaken or swirled to aid in the mixing of the substance and the liquid.

Figure 7:
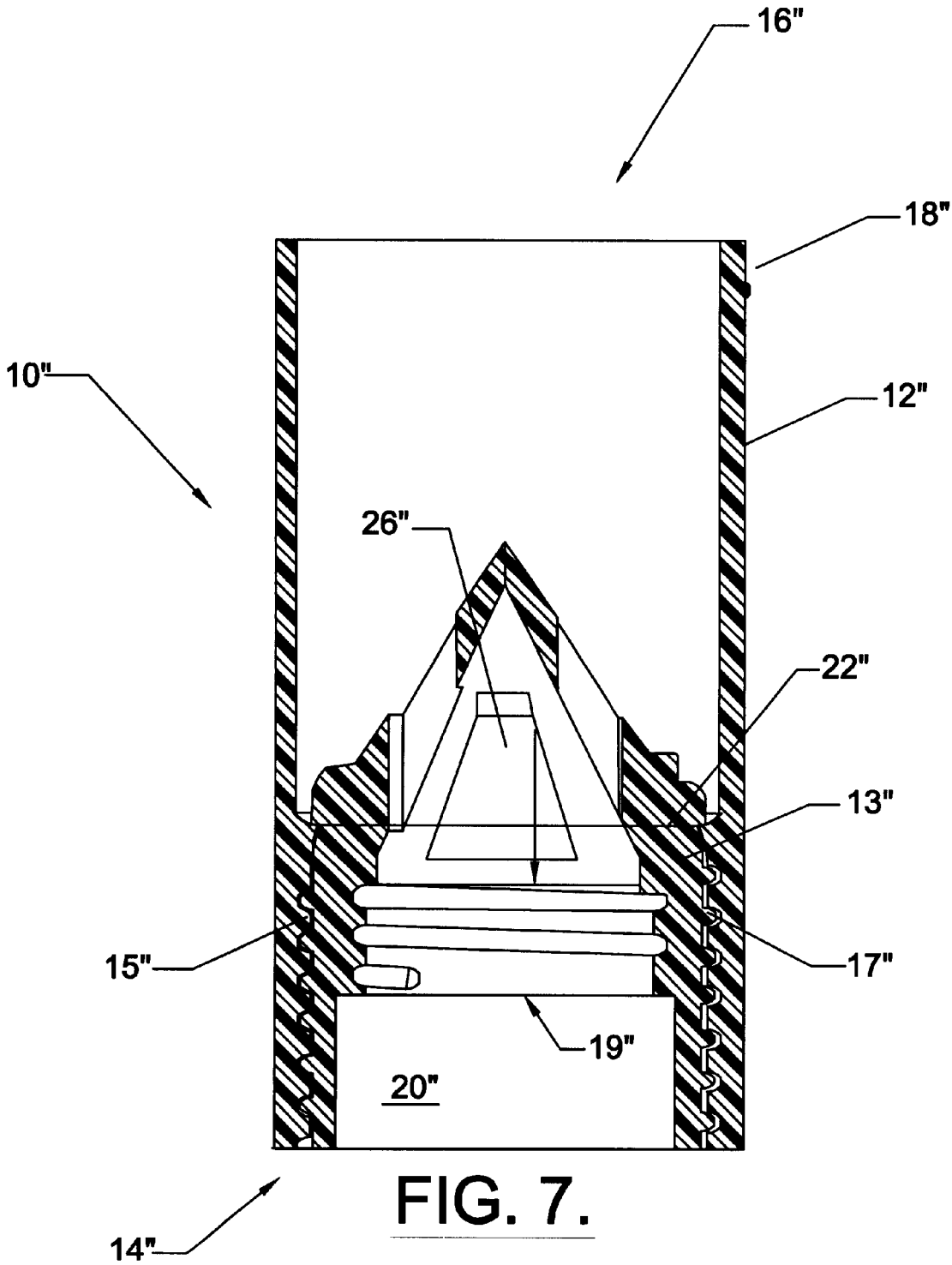
FIG. 7 is a cross-sectional view of another embodiment of the device of the present invention.

In a variation of the embodiment of FIGS. 3-6, a device 10" will now be described with reference to FIG. 7. Here, the device 10" includes a breaking cap 13" that also has internal threads 19". However, the breaking cap 13" also includes a skirt portion 20" for extending down over the top of the bottle. This ensures a more reliable, stable and secure fit and connection of the device 10" to the bottle. Of course, the breaking cap 13" may also be slidably disposed in the housing 12" via a friction fit, snap fit, protruding rings etc.

Figure 8:
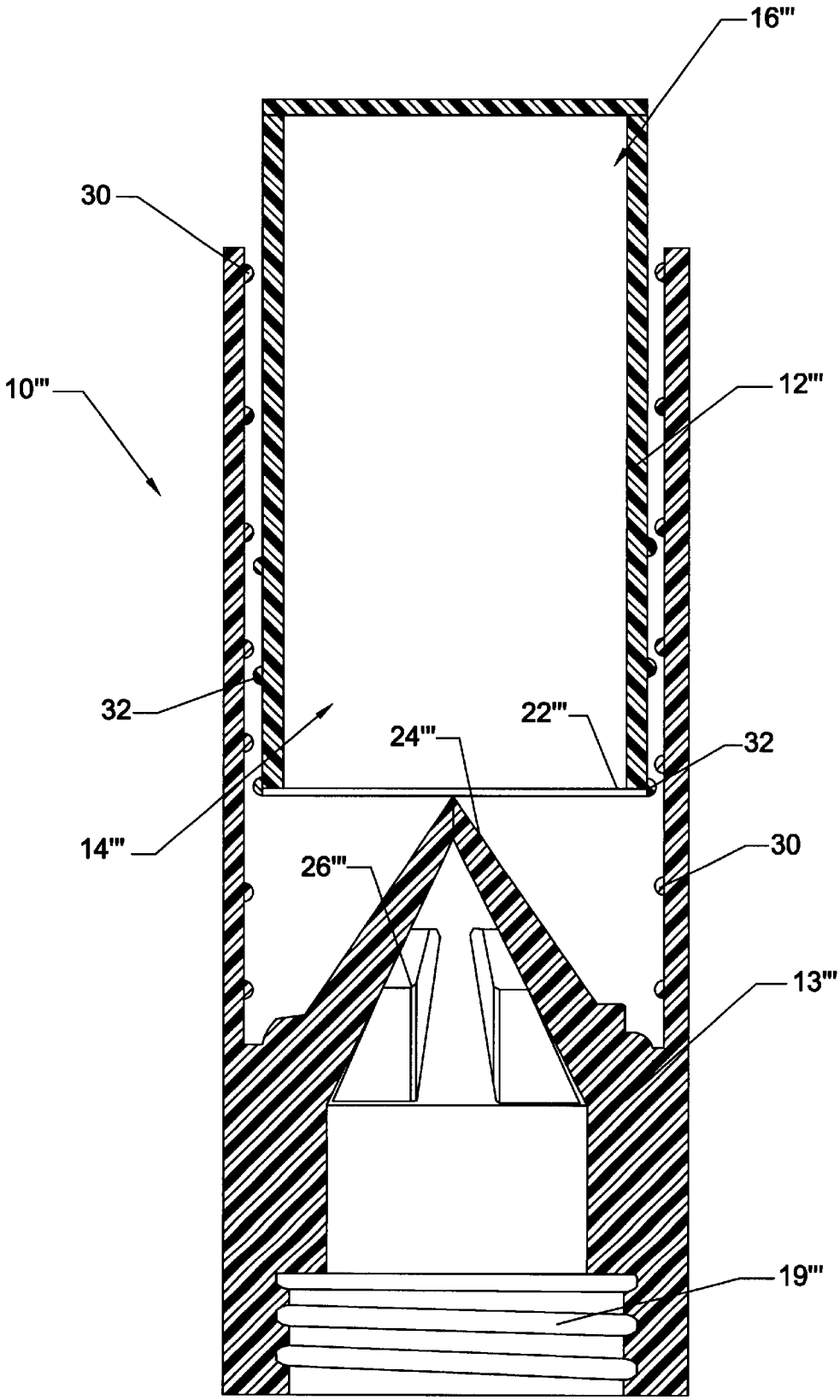
FIG. 8 is a cross-sectional view of yet another embodiment of the device of the present invention.

Additionally, as shown in the embodiment of FIG. 8, the device 10''' may be constructed so that the housing 12''' is received in the breaking cap 13'''. Such an embodiment may reduce the possibility of a leak as the substance contained in the housing 12''' would also be contained in the breaking cap 13''' while the breakable seal 22''' is ruptured by the protruding portion 24'''. Also, in this embodiment, the housing 12''' is secured within the breaking cap 13''' via protruding members 30 and 32 respectively located on the breaking cap 13''' and the housing 12'''. Of course, the housing 12''' may also be secured within the breaking cap 13''' via any other reliable fitting that would reliably secure the housing within the breaking cap while allowing movement therein, such as a snap fit, receiving grooves, threads etc.

The devices 10, 10', 10" and 10''' in accordance with the present invention provide sterile and convenient mixing and storing of pre-measured quantities of a substance and a liquid, thereby avoiding the possibility of spillage, contamination and the production of incorrect mixtures.

The devices 10, 10', 10" and 10''' illustrated in FIGS. 1–8 include an elongated and cylindrical shaped housing 12. However, other shapes and sizes which provide storage for the desired premeasured quantity of a substance, are also contemplated by the inventors. The device is preferably made of plastic, and may be transparent or opaque. The devices 10, 10', 10" and 10''' may be used to store powdered baby formula, diet drink powders, sports drink powders, liquor, pharmaceuticals or any other substance that would conveniently be stored and be ready to mix with another substance or liquid such as water, milk, juice or soda, for example.

The devices 10, 10', 10" and 10''' are preferably single serving disposable devices but may also be reusable depending on the typ of seal 22 used. The size, depth and diameter of the devices 10, 10', 10" and 10''' will be based on serving volume requirements. Additionally, various types of safety or tamper resistant devices may be appropriate to secure the piston 13 and breaking cap 13' or housing 12''' in an initial position prior to engagement with a bottle.

Furthermore, in the embodiments described with respect to FIGS. 3–8, the breaking cap 13', 13" and 13''' may be provided separately from the housing 12', 12" and 12'''. For example, the breaking cap 13', 13" and 13''' may be provided with the bottle containing the liquid for mixture with the substance stored in the housing 12', 12" and 12'''. Here, the breaking cap 13', 13" and 13''' may include a closure cap to mate with the external threads 17', 17' and 17''' and the combination may serve as a bottle cap for the bottle.

Many modifications and other embodiments of the invention will come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included within the scope of the appended claims.

That which is claimed is:

1. A storage and dispensing device for engaging a container and dispensing a stored substance therein, the device comprising:

a housing defining a chamber for storing the substance, the housing having an end and an opening adjacent thereto;

a breakable seal adjacent the opening of the housing for sealing the substance in the chamber; and a breaking member carried by the housing outside the chamber and adjacent the opening and the breakable seal for being driven by the container when engaged with the device to break the seal and allow dispensing of the substance into the container, the breaking member having internal threads and external threads, the internal threads for mating with the container;

the end of the housing including internal threads, between the opening and the breakable seal, for mating with the external threads of the breaking member.

2. A device according to claim 1, wherein the breaking member comprises a protruding portion and at least one opening therein.

3. A device according to claim 1, wherein the breakable seal is integrally formed with the housing as a monolithic unit.

4. A device according to claim 1, wherein the breakable seal comprises lines of weakness to aid in the breaking of the seal by the breaking member.

5. A device according to claim 1, wherein the breakable seal comprises a foil seal.

6. A device according to claim 1, wherein the housing has a second opening; and further comprising a cap for closing the second opening.

7. An apparatus for separately storing two substances to be mixed together at a time of use, the apparatus comprising:

a container for storing a first substance; and a device comprising a housing defining a chamber for storing a second substance, the housing having an end and an opening adjacent thereto, a breakable seal adjacent the opening of the housing for sealing the second substance in the chamber, and a breaking member carried by the housing outside the chamber and adjacent the opening and the breakable seal for being driven by the container when engaged with the device to break the seal and allow mixing of the second substance with the first substance, the breaking member having internal threads and external threads, the internal threads for mating with the container, the end of the housing including internal threads, between the opening and the breakable seal, for mating with the external threads of the breaking member.

8. An apparatus according to claim 7, wherein the breaking member comprises a protruding portion and at least one opening therein.

9. An apparatus according to claim 7, wherein the breakable seal is integrally formed with the housing as a monolithic unit.

10. An apparatus according to claim 7, wherein the breakable seal comprises lines of weakness to aid in the breaking of the seal by the breaking member.

11. An apparatus according to claim 7, wherein the breakable seal comprises a foil seal.

12. An apparatus according to claim 7, wherein the housing has a second opening; and further comprising a cap for closing the second opening.

13. A method of dispensing a first substance into a container for mixture with a second substance, the method comprising:

storing the first substance in a chamber of a device having an end and an opening adjacent thereto;

sealing the first substance in the chamber with a breakable seal adjacent the opening;

threading a breaking member into the device outside the chamber and adjacent the opening and the breakable seal; and engaging the device onto the container to drive the breaking member to break the seal and dispense the first substance into the container.

14. A method according to claim 13, wherein the breaking member comprises a protruding portion and at least one opening therein.

15. A method according to claim 13, wherein sealing the first substance in the chamber with the breakable seal comprises integrally forming the breakable seal with the housing as a monolithic unit.

16. A method according to claim 13, wherein the breakable seal comprises lines of weakness to aid in the breaking of the seal by the breaking member.

17. A method according to claim 13, wherein the breakable seal comprises a toil seal.

18. An apparatus according to claim 13, wherein the device has a second opening; and further comprising closing the second opening with a cap.

* * * * *